US006932715B2

(12) United States Patent
Sano

(10) Patent No.: US 6,932,715 B2
(45) Date of Patent: Aug. 23, 2005

(54) GOLF CLUB HEAD

(75) Inventor: Yoshinori Sano, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 10/277,729

(22) Filed: Oct. 23, 2002

(65) Prior Publication Data

US 2003/0083147 A1 May 1, 2003

(30) Foreign Application Priority Data

Oct. 23, 2001 (JP) ..... 2001-325272

(51) Int. Cl.[7] ..... A63B 53/04
(52) U.S. Cl. ..... 473/324; 473/349
(58) Field of Search ..... 473/324, 346, 473/347, 348, 349, 350, 131, 290, 291, 330, 331, 342

(56) References Cited

U.S. PATENT DOCUMENTS 4,391,381 A * 7/1983 Ota et al. ..... 428/35.7
5,743,812 A * 4/1998 Card ..... 473/327
6,033,315 A * 3/2000 Infantino ..... 473/122

FOREIGN PATENT DOCUMENTS

JP 9-3442 A 7/1999

* cited by examiner

*Primary Examiner*—Sebastiano Passaniti
(74) *Attorney, Agent, or Firm*—Birch, Stewart, Kolasch & Birch, LLP

(57) ABSTRACT

A golf club head including a head base body which surface is formed with a coating film, the coating film including a topcoat layer consisting of an acrylic resin coating material containing polyethylene wax of 1.0 to 10.0 parts by weight with respect to acrylic resin solid content of 100 parts by weight. It is possible to improve abrasion resistance while making the best use of excellent impact resistance of the acrylic resin coating material, and thus, to effectively prevent peeling of the coating film. Further, it is possible to enhance the interlayer adhesion of inner layers with the topcoat layer.

11 Claims, 1 Drawing Sheet

GOLF CLUB HEAD

BACKGROUND OF THE INVENTION

1. Field of the Invention

The present invention relates to a golf club head, which is capable of improving abrasion resistance and the like.

2. Description of Background Art

In a metallic golf club head, it is general knowledge to use coating materials containing an acrylic resin (polyacrylate), a polyester resin or a urethane resin as the base material. In particular, in order to protect the golf club head and to improve its abrasion resistance, a coating material using a polyester resin having a higher hardness than the base material is applied to the topcoat layer, forming the outermost layer of a coating film.

However, a golf club head using the polyester resin as the topcoat layer has the following problems, although it is excellent in abrasion resistance. That is, the club head is inferior in impact resistance because the coating film is hard. As a result, peeling due to cracking occurs rather easily. Moreover, the polyester resin-based coating material is inferior in interlayer adhesion as compared with other resin coating materials, even if it is the same kind of resin coating material. For this reason, when forming a coating film having the multi-layer structure, there is a problem that peeling rather easily occurs in the topcoat layer of the polyester resin-based coating material resulting from the low impact resistance as described above.

The present invention has been made in view of the above problem and thus provides a golf club head which has, on balance, an improved abrasion resistance, impact resistance and interlayer adhesion and is useful in effectively preventing a topcoat layer from peeling and to maintain a beautiful external appearance of the golf club head over a long period of time.

SUMMARY OF THE INVENTION

Accordingly, one aspect of the present invention is to provide an improved golf club head including a head base body whose surface is formed with a coating film, the coating film including a topcoat layer containing an acrylic resin coating material and a polyethylene wax in an amount of 1.0 to 10.0 parts by weight with respect to the acrylic resin solid content of 100 parts by weight. By doing so, it is possible to improve abrasion resistance while making the best use of excellent impact resistance of the acrylic resin coating material, and thus, to effectively prevent the peeling of the coating film. Further, it is possible to improve the interlayer adhesion of inner layers with the topcoat layer.

A second aspect of the present invention is to provide a golf club head, wherein the polyethylene wax has an average grain size of 10 to 25 $\mu$m.

A third aspect of the present invention is to provide a golf club head, wherein the maximum grain size of the polyethylene wax is less than 30 $\mu$m.

A fourth aspect of the present invention is to provide a golf club head, wherein the topcoat layer has a thickness of 15 to 35 $\mu$m.

According to the second to fourth aspects of the present invention, it is possible to improve on balance, the abrasion resistance and the impact resistance of the topcoat layer.

A fifth aspect of the present invention is to provide a golf club head, wherein the coating material includes a polarizing layer consisting of polyacrylate coating materials containing a polarizing material at the inner layer of the transparentized topcoat layer. By doing so, it is possible to maintain the beauty of the polarizing layer, improve the interlayer adhesion with the polarizing layer, and to effectively prevent peeling of the topcoat layer.

DESCRIPTION OF THE PREFERRED EMBODIMENTS

One embodiment of the present invention will be described below with reference to the accompanying drawings.

Figure 1:
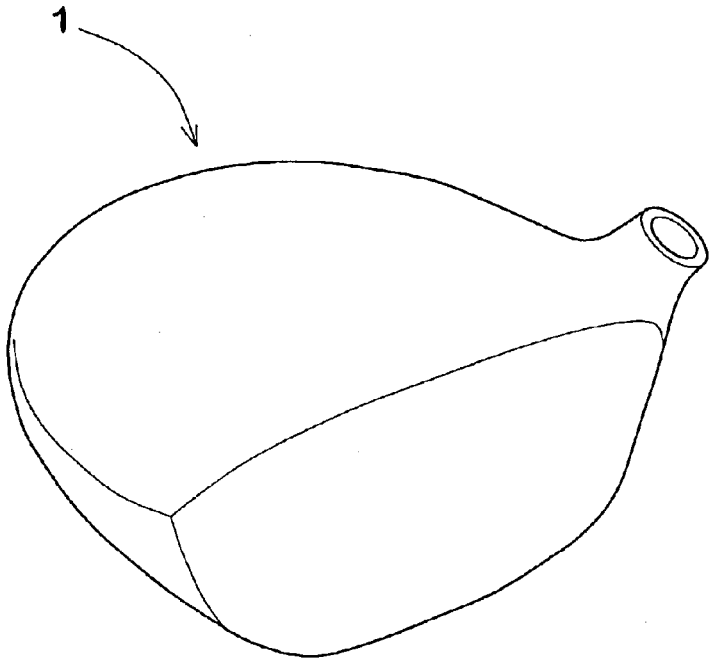
FIG. 1 is a perspective view showing the external appearance of a golf club head according to one embodiment of the present invention.

In FIG. 1, there is shown a wood type golf club head 1 (hereinafter, referred simply to as "head") as the golf club head of the present embodiment. In the head 1, according to the present embodiment, the surface of the head base body 2 is made of a metal material and is provided with a coating film 3 as shown in the partially enlarged view of FIG. 2.

Preferably, a titanium alloy having a high specific strength is employed as the head base body 2. In other embodiments other types of metallic materials and non-metallic materials may be employed. The head base body 2 of the present embodiment is formed in such a manner that parts prepared via machining, such as casting, forging and pressing are integrally joined. Further, the surface of the head base body 2 is previously polished by a wire brush, sand blast and the like, and physical surface preparation and degreasing are carried out.

According to the present embodiment, the coating film 3 is formed on the outer surface of the head base body 2 excluding a sole portion forming the bottom surface thereof. However, the coating film 3 is not limited to the above embodiment, and may be formed on at least a part of the head base body 2. The coating film 3 of the present embodiment comprises a plurality of layers. More specifically the coating film 3 may comprise a substrate layer 3*a* which is formed at the most nearest side of the head base body 2, a colored layer 3*b* formed at the outer side of the substrate layer 3*a*, a polarizing layer 3*c* which is formed at the outer side of the colored layer 3*b*, and the topcoat layer 3*d* which is formed at the outer side of the polarizing layer 3*c* so as to form the head outer surface.

The above substrate layer 3*a* is formed by applying an achromatic and transparent primer to the head base body 2, which has been subjected to finishing. Preferably, for example, a thermosetting achromatic and transparent coating material is used as the primer. The thermosetting achromatic and transparent coating material uses a polyester resin, an epoxy resin, an acrylic resin or the like as the base resin. In the present embodiment, a liquid thermosetting polyester coating primer is used because it has excellent adhesion with metallic materials such as titanium alloys and stainless and is durable to impact. A one-part liquid thermosetting polyester coating primer is suitably adopted.

After the primer is uniformly coated to the head base body 2, it is baked by heating at the temperature of about 100 to 200 degree centigrade, for example 150 degree centigrade for about 15 to 20 minutes, and hardened thereby. By doing so, it is possible to fix the primer hardened film, that is, the above substrate layer 3*a* on the surface of the head base body 2. The substrate layer 3*a* serves not only to improve interlayer adhesion with coating materials later applied, but also to find a pinhole formed in manufacturing of the head. If a pinhole is found, it is repaired using putty in the surface preparation stage. The thickness of the substrate layer 3*a* is not specially limited; however, it is desirable that the thickness is set to a range from 5 to 40 μm, more preferably, a range from 10 to 25 μm. If the thickness of the substrate layer 3*a* is smaller than 5 μm, there is the problem that it is difficult to make smooth the concavity and convexity of the head surface. Conversely, if the thickness is larger than 40 μm, it is not preferable, since adhesion and impact resistance is reduced.

The above colored layer 3*b* is formed by applying a color coating material to the outside of the substrate layer 3*a*. The color coating material is not specially limited; however, various thermosetting coating materials may be used. The coating materials include polyester resins, urethane resins, epoxy resins, acrylic resins or the like as the base resin, which is mixed with a pigment and a solvent. The color coating material of the present embodiment uses a base resin consisting of an acrylic resin mixed with a pigment. In this case, dye may be used in place of the pigment. After the color coating material is applied, baking is carried out at a temperature of about 100 to 200 degree centigrade, for example 150 degree centigrade for about 15 to 20 minutes, for example 15 minutes and the color coating material is hardened on the substrate layer 3*a* whereby the colored layer 3*b* is formed. If the thickness of the colored layer 3*b* is too thin, a skilled technique is required in the coating process and it is also hard to obtain the feeling of the thickness of the coating film, in its appearance. Conversely, if the thickness of the colored layer 3*b* is too thick, the colored layer 3*b* becomes fragile and as a result, the impact resistance is reduced. Considering the above problems, it is desirable that the thickness of the colored layer 3*b* is set to a range from 10 to 50 μm, more preferably, a range from 20 to 40 μm.

The above polarizing layer 3*c* is formed by coating a polarizing coating material containing a polarizing material 4 on the outside of the colored layer 3*b*. The polarizing coating material is prepared by mixing a polarizing material 4 in a transparent thermosetting coating material using a polyester resin, a urethane resin, an epoxy resin, an acrylic resin, or the like as the base resin. In the present embodiment, a coating material containing no developing agent such as coloring agent is used. For example, mica flake, materials coating the surface of mica with titanium oxide, metallic flake having a resin-treated surface, colored aluminum flake and the like are used as the polarizing material 4. The colored aluminum flake is formed in a manner of coloring an aluminum flake by vapor deposition. Therefore, unevenness of the photo-color is less as compared with other polarizing materials, and a beautiful appearance is obtained. Further, the colored aluminum flake has the shape of a flake and the size of the flake is generally set to be in a range of from 10 to 100 μm.

Many of the polarizing materials usually have the shape of a flake, and most of them are oriented substantially parallel to the coating surface. For this reason, when viewing the coating surface from a substantially vertical direction, the head appears to have a specific color, that is, the basic color of the colored layer 3*b*. In this case, when tilting the coating surface, light reflection and diffraction occur and as a result, the head appears to have a different color. By doing so, a high grade feeling and beautiful appearance can be unexpectedly obtained from the head. Such a color change is produced by environmental lights.

The polarizing material 4 is not specially limited and it is preferable to adopt a mixed amount of the polarizing material 4 in a range of from about 0.1 to 7.5%, more preferably, a range from about 0.5 to 5.5% by weight, if the total sum of the base resin and the polarizing material is set as 100% (excluding solvent component). If the amount of the polarizing material 4 is too much, the amount of light reflection by the polarizing material increases. For this reason, the head is glaring when the user addresses the club. Conversely, if the mixing amount is too little, the polarizing effect obtained from using the polarizing material 4 is not sufficiently exhibited. As a result, the design characteristics of the head can not be improved.

In the present embodiment, the thermosetting coating material mixing the colored aluminum flake and the base resin consisting of the acrylic resin is used as the polarizing material. Further, the above coating material is coated onto the outer surface of the colored layer 3*b*, and thereafter, is baked by being heated at the temperature of 150 degree centigrade for 10 to 20 minutes. The thickness of the polarizing layer 3*c* is not specially limited. If the thickness is too thin, the polarizing effect is not sufficiently obtained. Conversely, if the thickness is too thick, the impact resistance is reduced. For this reason, it is desirable that the thickness is set to be in a range of from 10 to 40 μm, more preferably, a range from 15 to 35 μm. It is preferable to use an acrylic resin as the base resin of the polarizing layer 3*c*, because the acrylic resin is excellent in weather resistance (discoloration resistance) as compared with other resins, and the control of the coating layer thickness is readily carried out. If polyester resin is used as the base resin of the polarizing layer 3*c*, the coating layer thickness can become too thick and for this reason, the control is difficult. Moreover, if a urethane resin or epoxy resin is used, they readily discolor. For this reason, the design characteristics of the polarizing layer 3*c* can be easily lost.

The topcoat layer 3*d*, in the embodiment, is formed by mixing a polyethylene wax into an acrylic resin base resin. In the present embodiment, a substantially transparent polyethylene wax and an acrylic resin are used. The polyethylene wax is one kind of synthetic wax which uses polyethylene having a low polymerization degree or the oxide thereof, as a raw material. It is preferable that the molecular weight of the polymer is about 100 to 100000, more preferably, about 1000 to 10000. Further, it is preferable that the softening point is at 80 to 160 C, more preferably, 90 to 140 degree centigrade. The above-mentioned polyethylene wax is in particle form at room temperature, and may be used either as a particle powder or as a slurry previously dispersed in a solvent, which is sold on the market.

Figure 2:
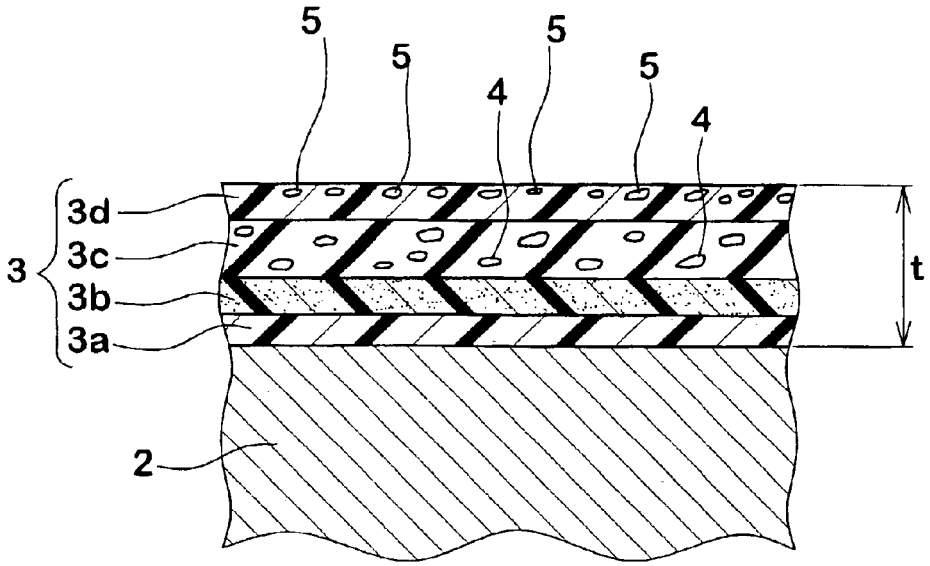
FIG. 2 is a partially enlarged cross-section view showing the coating film of the golf club head.

Conventionally, the coating material using an acrylic resin as the base resin has a low abrasion resistance. Also, it is difficult to repair defects such as fuzz in the coating process, and fine coating unevenness of the boundary of the masking portion. For this reason, the above coating material is not suitable for a topcoat layer. However, it has been determined that if the above polyethylene wax is mixed into the acrylic resin, and thereby, as schematically shown in FIG. 2, hard polyethylene particles 5 are distributed principally in the vicinity of the surface of the topcoat layer 3*d*, in a coating material hardening reaction the surface film hardness of the topcoat layer 3*d* is improved therefore, it is possible to improve the low abrasion resistance, which has been conventionally considered to be too low. Furthermore, the acrylic resin provides an excellent impact resistance as compared with polyester resins, and has a higher interlayer adhesion with the same kind of resin (i.e., the acrylic resin). Therefore, it is possible to prevent interlayer peeling. Thus, the topcoat layer 3*d* improves abrasion resistance while making the best use of the excellent characteristics of the acrylic resin. As a result, it is possible to prevent peeling of the topcoat layer 3*d*, and to maintain a beautiful appearance of the head for a long period of time. In this case, an epoxy resin or a urethane resin is considered as the base resin of the coating material for the topcoat layer 3*d*. However, these resins are not preferable because they have a low weather resistance and a yellowing effect with age. Moreover, a wax using a polyolefin is sold on the market. However, the wax is not suitable for the topcoat layer 3*d* because its transparency is low.

It is desirable that the mixing amount of polyethylene wax is set to a range from 1.0 to 10.0 parts by weight, more preferably, a range from 3.0 to 5.0 parts by weight with respect to acrylic resin solid content of 100 parts by weight. If the mixing amount of polyethylene wax is less than 1.0 part by weight, it is difficult to improve the abrasion resistance of the topcoat layer 3*d*. Conversely, if the mixing amount of polyethylene wax exceeds 10.0 parts by weight, not only the effect of improving the abrasion resistance does not increase any more, but also the topcoat layer 3*d* becomes cloudy. As a result, the degree of transparence is reduced, and design characteristics are lost in the color layer 3*b* and the polarizing layer 3*c* formed inside the topcoat layer 3*d*. The coating material forming the topcoat layer 3*d* includes a solvent other than the acrylic resin and the polyethylene wax, and is formed as a liquid composition. Further, the coating material is coated on the outside of the polarizing layer 3*c* with a brush, an airbrush, a spray gun, etc.

Moreover, it is desirable that the polyethylene wax has an average grain size of 10 to 25 μm, more preferably, 15 to 25 μm at room temperature. If the average grain size of the polyethylene wax is less than 10 μm, the particle is too small. This is a factor which reduces the effect of improving the surface hardness of the topcoat layer 3*d*. As a result, the topcoat layer 3*d* lacks abrasion resistance. Conversely, if the average grain size of the polyethylene wax exceeds 25 μm, the topcoat layer 3*d* becomes thicker than the general layer. Thus, polyethylene wax particles project from the surface of the coating film. As a result, smoothness is lost from the surface of the head 1. More preferably, the maximum grain size of the polyethylene wax is limited to 30 μm or less.

The thickness of the topcoat layer 3*d* is not specially limited; however, in this case, it is desirable that the thickness of the topcoat layer 3*d* is set to be within a range of from 15 to 35 μm, more preferably, a range from 15 to 30 μm. If the thickness of the topcoat layer 3*d* is less than 15 μm, there is the possibility that the polyethylene wax will be exposed from the surface thereof. As a result, the smoothness of the topcoat layer 3*d* is lost. Conversely, if the thickness of the topcoat layer 3*d* exceeds 35 μm, the rigidity of the coating film becomes high, and the impact resistance is reduced. For this reason, it is not preferable. In particular, it is desirable that the whole thickness t of the coating film 3 is set to 100 μm or less, preferably, a range of from 25 to 90 μm, more preferably, a range of from 40 to 80 μm. If the entire thickness t of the coating film 3 exceeds 100 μm, the coating film 3 becomes fragile, and the impact resistance is reduced. In addition, the user readily feels the excessive thickness of the coating film 3, and feels the weight of the head.

As described above, in the embodiment of the present invention, the wood type golf club head has been cited as the example. However, the present invention is not limited to the above embodiment, and thus is also applicable to the head of an iron, a utility, further putter. Further, the coating film 3 may be any other form so long as it includes the topcoat layer 3*d*, and the polarizing layer 3*c* may be omitted.

EXAMPLE

Based on the specifications shown in the following Table 1, the surface of the head base body was formed with the coating film, and a plurality of test golf club heads was experimentally manufactured. Test was made with respect to the coating film, that is, abrasion resistance, impact resistance, adhesion of topcoat layer, and external appearance. Any coating films comprise four layers, and as the common specifications, an epoxy resin coating material was used as the primer, an acrylic resin coating material was used as the color layer, and an acrylic resin coating material mixing aluminum flake was used as the polarizing material of the polarizing layer. The coating film thickness of each layer was set to generally 15 to 25 μm so that the whole thickness can be made 100 μm or less. Further, baking was carried out at the temperature of 150 degree centigrade for 20 minutes. The test was made in the following manner.

<Abrasion Resistance>

The coating film of the head was polished by cloth buff, thereafter, the clouding state of the head surface was visibly observed, and then, evaluation was made based on the following references.

◎: No haze

○: haze exists; however, the design of polarizing layer and color layer is not lost X: haze exists, and the design of both polarizing layer and color layer is lost <Impact Resistance>

An iron rod of 500 g was dropped on the coating film of the head from the height of 150 mm, thereafter, the peeling state of the coating film at the collision portion was visibly observed. The dimension and depth of damage were observed, and then, a five-grade evaluation was made. When the numeral is larger, the coating film is more preferable.

<Adhesion>

After aging for 240 hours at room temperature of 50 degree centigrade and humidity of 90%, cross hatch evaluation (1 mm square X 100 was made confined to JIS-K5400, thereafter, the evaluation was made based on the following references.

○: Peeling is 0 to 10/100

X: Peeling is 11/100 or more

<External Appearance>

The topcoat layer was formed, thereafter, the external appearance of the topcoat layer was visibly observed, and then, the evaluation was made based on the following references.

◎: No haze and transparent

○: haze exists; however, the design of polarizing layer and color layer is not lost.

X: haze exists, and the design of both polarizing layer and color layer.

The above test results are shown in the following Table 1.

The above test is made; as a result, the examples of the present embodiment were reconfirmed that abrasion resistance, impact resistance, and external appearance were improved in balance as compared with the comparative examples.

It is understood that while certain forms of the present invention have been illustrated and described herein, it is not to be limited to the specific forms or arrangements of parts described and shown.

TABLE 1

| | | Example 1 | Example 2 | Example 3 | Example 4 | Example 5 | Example 6 | Comparative example 1 | Comparative example 2 | Comparative example 3 |
|---|---|---|---|---|---|---|---|---|---|---|
| Specifications of topcoat layer | Mixing amount (parts by weight) of polyethylene wax with respect to acrylic resin solid content of 100 parts by weight | 1.5 | 3.0 | 5.0 | 9.5 | 4.0 | 4.0 | 0.1 | 11.0 | Polyester resin coating material |
| | Average grain size (μm) of polyethylene wax | 20 | 15 | 25 | 10 | 25 | 5 | 25 | 25 | |
| Test results | Abrasion resistance | ○ | ◎ | ◎ | ○ | ◎ | ○ | x | ◎ | ◎ |
| | Impact resistance | 5 | 5 | 5 | 5 | 5 | 5 | 5 | 5 | 3 |
| | Adhesion of topcoat | ○ | ○ | ○ | ○ | ○ | ○ | ○ | ○ | x |
| | External appearance (clouding) | ◎ | ◎ | ◎ | ◎ | ◎ | ○ | ◎ | x | ◎ |

*Polyethylene wax: molecular 5,000, softening point 120° C.

What is claimed is:

1. A golf club head including a head base body which surface is formed with a coating film, the coating film including a topcoat layer comprising an acrylic resin coating material containing 1.0 to 10.0 parts by weight of polyethylene wax based on 100 parts by weight of the solid content of the acrylic resin.

2. The golf club head according to claim 1, wherein the polyethylene wax has an average grain size of 10 to 25 μm.

3. The golf club head according to claim 1 or 2, wherein the maximum grain size of the polyethylene wax is less than 30 μm.

4. The golf club head according to claim 1 or 2, wherein the topcoat layer has a thickness of 15 to 35 μm.

5. The golf club head according to claim 1 to 2, wherein the coating film includes a polarizing layer consisting of an acrylic resin coating material containing a polarizing material provided at the inner surface of the transparent topcoat layer.

6. The golf club head of claim 1 wherein the polyethylene wax is in particle form and primarily distributed in the vicinity of the surface of the top coat layer.

7. The golf club head of claim 1 wherein a polarizing layer is disposed between the golf club head and the top coat, such polarizing layer comprising a thermosetting resin and a polarizing material.

8. The golf club head of claim 7, wherein the thermosetting resin is an acrylic resin and the polarizing material is a metallic flake.

9. The golf club head of claim 8, wherein the metallic flake is present in an amount of about 0.1 to 7.5% based on the amount of base resin and polarizing material.

10. A golf club head containing a coating film which comprises:

a substrate layer, a colored layer containing a thermosetting acrylic resin and a pigment, a polarizing layer containing a thermosetting resin and a polarizing material, and a top coat layer comprising an acrylic resin and a polyethylene wax.

11. The golf club head of claim 10 wherein the thermosetting resin of the polarizing layer is an acrylic resin.

* * * * *